United States Patent [19]

King

[11] Patent Number: 4,890,396

[45] Date of Patent: Jan. 2, 1990

[54] ADJUSTABLE CLOTHES DRYER VENT CONNECTION

[76] Inventor: Timothy P. King, 2087 Northwest 140th St., Shakopee, Minn. 55379

[21] Appl. No.: 231,341

[22] Filed: Aug. 12, 1988

[51] Int. Cl.[4] ..... F24F 13/18

[52] U.S. Cl. ..... 34/235; 98/119; 98/114

[58] Field of Search ..... 34/235; 98/119, 99.7; 285/223, 224

[56] References Cited

U.S. PATENT DOCUMENTS 4,081,915 4/1978 Babcerowkz et al. ..... 98/119 X 4,214,380 7/1980 Meyer ..... 34/235

*Primary Examiner*—Henry A. Bennet

*Assistant Examiner*—John Sollecito

*Attorney, Agent, or Firm*—John W. Adams

[57] ABSTRACT

An adjustable clothes dryer vent mounted between the studs within the wall of a house and providing an adjustable connection between the housing and the dryer outlet.

4 Claims, 3 Drawing Sheets

ADJUSTABLE CLOTHES DRYER VENT CONNECTION

BACKGROUND OF THE INVENTION

In the past, clothes dryers have had to be moved forward out into the room away from the wall in order to provide space for the exhaust vent conduit connected with the dryer vent outlet at the back of the dryer. This invention is designed to permit the dryer to be located back substantially into flush position against the inside wall surface by providing an adjustable connector assembly positioned between the wall suds to permit connection of the dryer outlet and the exhaust vent conduit which extends out through the outside wall to the outside air.

SUMMARY OF THE INVENTION

This invention is specifically designed to provide an adjustable connection between the dryer vent outlet and the exhaust vent conduit so that the dryer can be pushed back into substantial engagement with the inside wall surface. This is accomplished by mounting this adjustable connection into the wall space between the studs and in one form of the invention extending the conduit directly out through the outside wall as shown in FIG. 3 of the drawings. An alternative form of the invention may be located down in the space between adjacent floor joists and run out to the outside wall through that space between the floor joists. This construction is illustrated in FIG. 2 of the drawing.

DETAILED DESCRIPTION OF THE INVENTION

Figure 1:
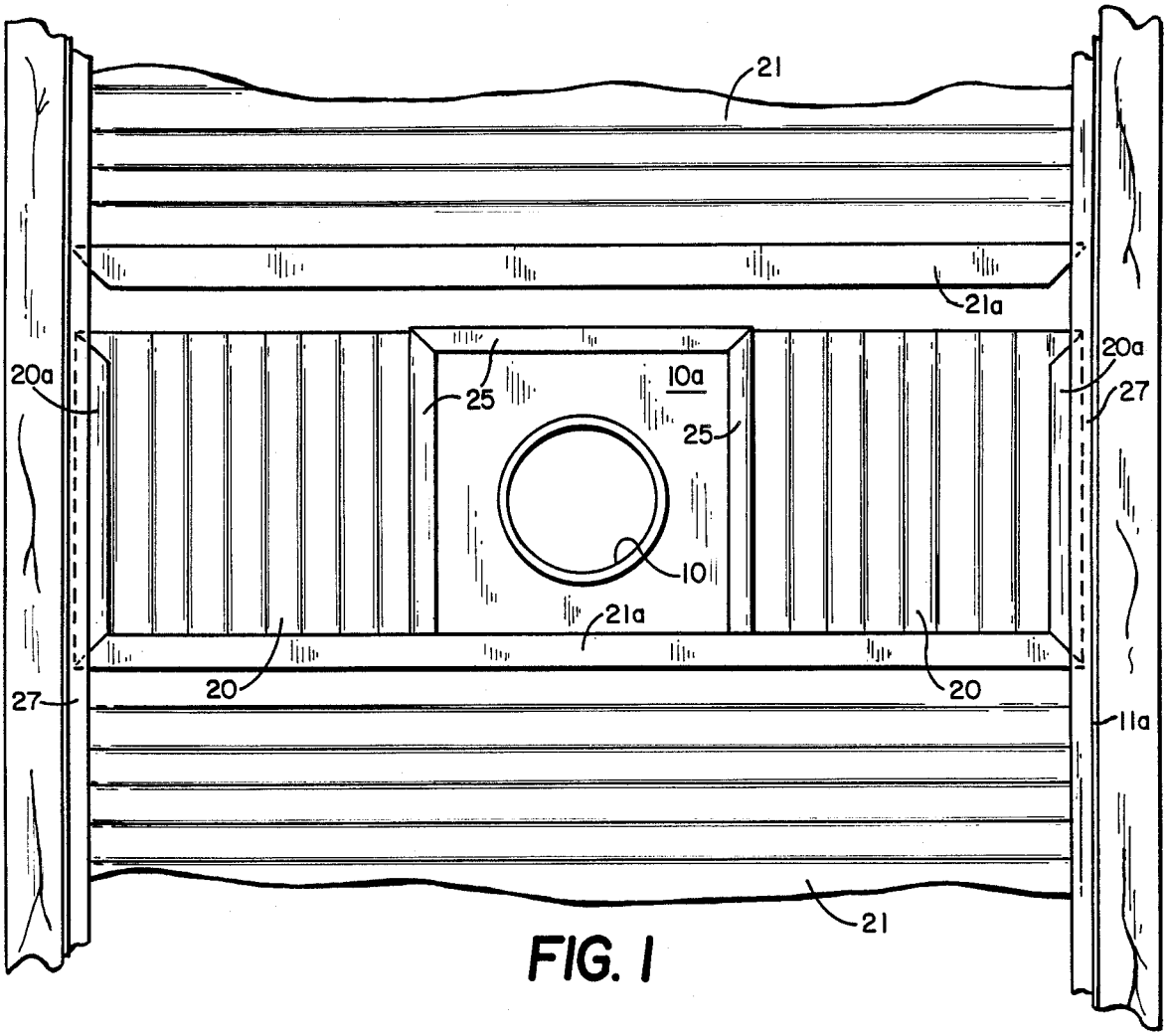
FIG. 1 is a front elevational view showing the adjustable connector assembly.

This invention includes a rigid or fixed connector box or housing 11 defining a connection chamber 11a therewithin and which is adapted to be mounted in the space between adjacent wall studs 5 and may be positioned on the floor plate 4 on which the studs are mounted. A trim molding 12 may be provided around the inside edge of box 11. An adjustable connector sleeve 10 is fixed to a mounting plate **10*a* which in turn is fixed to an inner slide frame 25. The frame 25 is slidably mounted in a pair of horizontally disposed channel rails 21*a* forming a horizontal track. In the form shown the horizontal channel members 21*a* are rigidly connected to a pair of outer-frame vertical members 20*a* at their outer ends to form an outer slide frame structure slidably mounted in vertical guiding channels 27 fixed to inside of the vertical panels 11*a* of connector box 11**.

Figure 3:
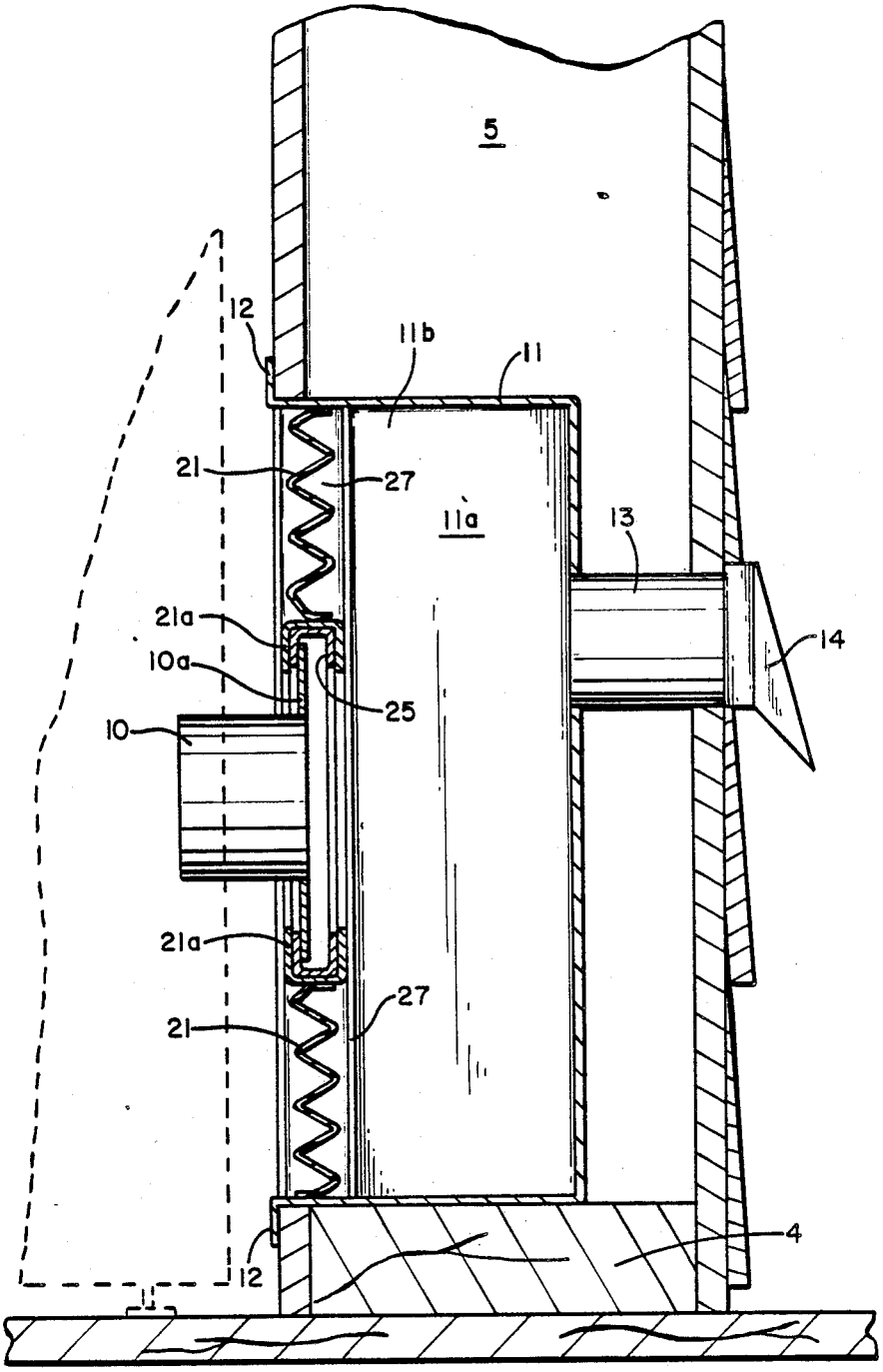
FIG. 3 is a central transverse sectional view showing an alternative form of installation.

FIG. 3 illustrates the simplest form of this invention wherein the back of a dryer is positioned substantially against the inside surface of an outside wall of a house so that an exhaust conduit 13 from the box 11 will extend directly through the outside wall and be discharged through a conventional hooded vent 14 mounted on the outside of the outside wall as shown.

In this form of the invention an adjustable connector sleeve 10 is provided for connection to the exhaust vent outlet of a dryer (partially shown in dotted lines in FIG. 3). A trim molding or frame 12 is connected to a connector box 11 to engage the surrounding surface of the inside wall as illustrated. An exhaust conduit 13 is fixed to the back panel of the box 11 and is designed to extend through the outside wall as illustrated. This exhaust conduit 13 may be provided with a vent deflector hood 14 as shown. The connector sleeve 10 is mounted on a flange **10*a* supported by two pairs of accordion pleated flexible panels 20 and 21. The adjustable flexible side panels 20 have their inner edges secured to a slide frame 25 to which the flange 10*a* is fixed and the panels 20 are connected to the vertical slide channels 20*a***at the outer edges thereof.

The vertical position of the connector conduit 10 may be adjusted by the accordion pleated flexible panels 21 with the respective vertical channels **21*a* securely fixed to the upper and lower edges of the housing 25, channels 20*a*. The upper and lower edges of the pleated vinyl panels 20*a* sealingly engage the inside of the respective channels 21*a*. The upper and lower edges of the adjustable panels 21 are respectively sealed by engagement with the upper and lower channels which are fixed to the respective upper and lower panels of the connector box 11**.

Figure 2:
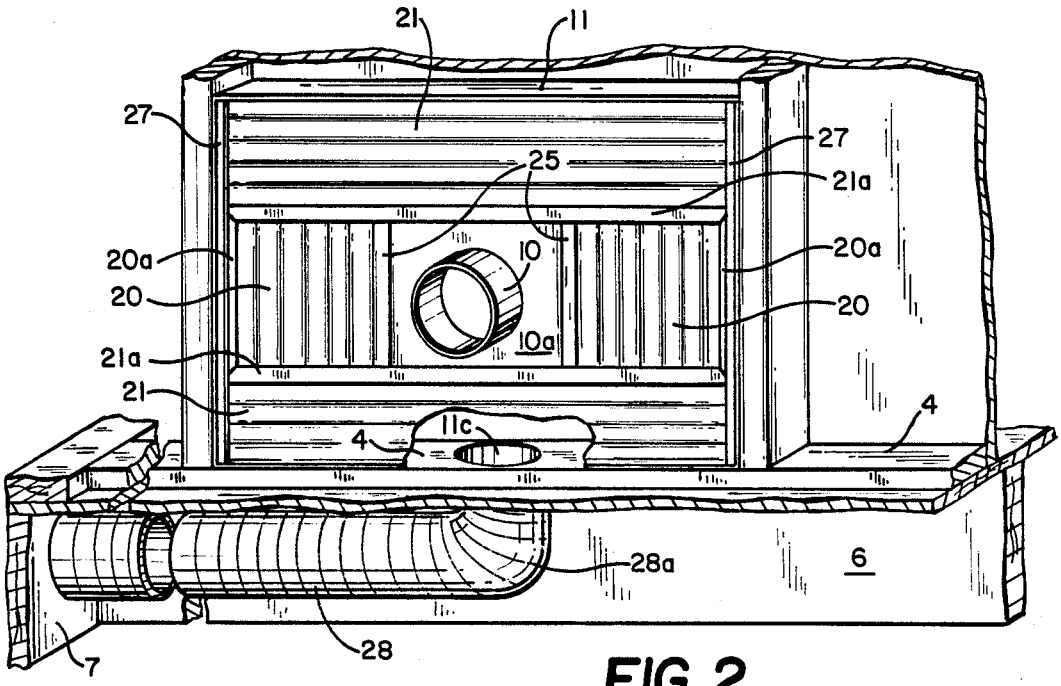
FIG. 2 is a front vertical perspective view with portions broken away showing one type of installation.

FIG. 2 illustrates an alternative connection between the box 11 and the outer vent conduit. In the connection arrangement shown in FIG. 2, the conduit 10 enters the chamber of the box 11 in the same manner as previously described. However, the outlet **11*c* from the chamber defined by box 11 extends downwardly through the plate 4 and the floor disposed therebelow and is connected to a discharge conduit 28 through an opening cut in the plate and floor sections in registration with outlet 11*c*. A conduit elbow 28*a* of conventional design may be used to connect the outlet 11c to the outlet conduit 28. The conduit 28 is then extended through the space between the adjacent floor joists 6 and is discharged to the outside of the house through the outside header 7 connecting the outer ends of the floor joists 6**.

What is claimed is:

1. An adjustable clothes dryer vent comprising, a housing defining a communication chamber there within, an adjustable connector sleeve mounted on one side of said housing for connection to the exhaust vent of a clothes dryer when the housing has been mounted between the wall studs of a building, sealing means between said sleeve and the housing chamber, said sealing means including means for adjusting the sleeve both vertically and horizontally to permit registration and connection with the dryer vent opening, exhaust conduit connected to said housing to provide a discharge outlet from the housing chamber, and wherein the adjustment for said connector sleeve is provided by apparatus which includes a pair of horizontally disposed spaced apart channel rails forming a horizontal track and a pair of spaced apart vertically disposed channel members receiving the ends of said horizontal rails to permit vertical adjustment of said horizontal members and means for sealing the open areas of the side of the housing surrounding said sleeve while permitting said vertical and horizontal adjustment thereof.

2. The structure set forth in claim 1 wherein said sealing means includes accordion pleated panels respectively closing areas disposed above and below said horizontal rails and accordion pleated adjustment panels respectively closing the areas on the respective side portions of said sleeve disposed between said channel rails.

3. The structure set forth in claim 1 wherein said exhaust conduit is mounted in the rear portion of said housing and extends directly horizontally outwardly therefrom through the outside wall of a house.

4. The structure set forth in claim 1 wherein said exhaust conduit is connected with the bottom of said housing and extends downwardly through the floor of the house, outwardly between the floor joists and ultimately through the outside wall of the house.

* * * * *